US009698510B2

(12) United States Patent
Ono et al.

(10) Patent No.: US 9,698,510 B2
(45) Date of Patent: Jul. 4, 2017

(54) CONNECTOR FOR SECURING A FLAT CABLE

(71) Applicant: MOLEX INCORPORATED

(72) Inventors: Takumi Ono, Yamato (JP); Hideki Iijima, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/037,014

(22) PCT Filed: Dec. 26, 2014

(86) PCT No.: PCT/JP2014/084491

§ 371 (c)(1),
(2) Date: May 16, 2016

(87) PCT Pub. No.: WO2015/099117

PCT Pub. Date: Jul. 2, 2015

(65) Prior Publication Data

US 2016/0301151 A1 Oct. 13, 2016

(30) Foreign Application Priority Data

Dec. 27, 2013 (JP) ..... 2013-273021

(51) Int. Cl.

| | |
|---|---|
| ***H01R 13/62*** | (2006.01) |
| ***H01R 12/88*** | (2011.01) |
| ***H01R 12/77*** | (2011.01) |

(52) U.S. Cl.

CPC ..... *H01R 12/88* (2013.01); *H01R 12/77* (2013.01); *H01R 13/62* (2013.01)

(58) Field of Classification Search

CPC ..... H01R 12/77; H01R 12/79; H01R 12/87–12/89; H01R 13/15; H01R 13/62;
(Continued)

(56) References Cited

U.S. PATENT DOCUMENTS

| | | | | |
|---|---|---|---|---|
| 6,280,217 | B1 | 8/2001 | Lin | |
| 7,261,588 | B2 * | 8/2007 | Yokoyama | H01R 12/88 439/267 |

(Continued)

FOREIGN PATENT DOCUMENTS

| | | | |
|---|---|---|---|
| JP | 09-283236 | A | 10/1997 |
| JP | 11-31561 | A | 2/1999 |

(Continued)

*Primary Examiner* — Chandrika Prasad
(74) *Attorney, Agent, or Firm* — James A. O'Malley

(57) ABSTRACT

In the connector, each terminal has a base portion, a rear upper beam, a front upper beam, a rear lower beam, and a front lower beam. The actuator includes a cam portion pushing the rear upper beam upwards, and the rear lower beam includes a fixed portion. The front lower beam includes a contact point which establishes contact with the flat cable, and a front end of the lower surface of the front lower beam establishing contact with the upper surface of the bottom portion of the housing. The contact point is positioned to the rear of the upper end of the lower surface of the front lower beam, and the front lower beam and the rear lower beam curve upward when the rear upper beam is pushed upwards, the front end of the lower surface of the front lower beam and the fixed portion serving as the support point.

9 Claims, 9 Drawing Sheets

(58) Field of Classification Search
CPC ..... H01R 13/62905; H01R 13/193; H01R 13/639; H01R 13/6392
USPC ..... 439/259–267, 370
See application file for complete search history.

(56) References Cited

U.S. PATENT DOCUMENTS

| | | | | |
|---|---|---|---|---|
| 7,300,304 | B1 | 11/2007 | Takashita et al. | |
| 7,347,720 | B2 | 3/2008 | Takashita | |
| 7,435,122 | B2 * | 10/2008 | Suzuki | H01R 12/771 439/260 |
| 7,452,227 | B2 * | 11/2008 | Matoba | H01R 12/778 439/260 |
| 7,604,499 | B2 * | 10/2009 | Sunaga | H01R 12/88 439/495 |
| 7,677,917 | B2 * | 3/2010 | Hemmi | H01R 12/88 439/495 |
| 8,684,766 | B2 | 4/2014 | Kakino et al. | |
| 8,936,496 | B2 | 1/2015 | Takane et al. | |
| 2006/0270270 | A1 * | 11/2006 | Yokoyama | H01R 12/88 439/495 |
| 2007/0224848 | A1 * | 9/2007 | Takashita | H01R 12/88 439/67 |
| 2009/0170367 | A1 * | 7/2009 | Hemmi | H01R 12/88 439/372 |

FOREIGN PATENT DOCUMENTS

| | | | |
|---|---|---|---|
| JP | 2011-222270 | A | 11/2011 |
| WO | WO 2011/094701 | A2 | 8/2011 |

* cited by examiner

CONNECTOR FOR SECURING A FLAT CABLE

RELATED APPLICATIONS

This application claims priority to Japanese Application No. 2013-273021, filed Dec. 27, 2013, and International Application No. PCT/JP2014/084491, filed Dec. 26, 2014, both of which are incorporated herein by reference in their entirety.

TECHNICAL FIELD

The present disclosure relates to a connector.

BACKGROUND ART

As electronic devices become smaller, demand is growing for smaller connectors able to receive an inserted flat cable such as an FFC or FPC. These connectors include a housing, terminals accommodated inside the housing, and an actuator for moving the terminals so that the terminals press against the flat cable.

Each terminal has a base portion extending vertically, a front upper beam and a front lower beam extending forward from the base portion, and a rear upper beam and a rear lower beam extending to the rear from the base portion. The cam portion of the actuator is arranged between the rear upper beam and the rear lower beam.

One of these connectors has the configuration disclosed in Patent Document 1 in which the rear upper beam is pushed up when the cam portion rotates between the rear upper beam and the rear lower beam. When the rear upper beam is pushed up, the front upper beam is inclined downward elastically with the base portion serving as the support point, and the space between the front upper beam and the front lower beam is narrowed. In this way, the front upper beam presses against the surface of the flat cable, and the flat cable is pinched and secured by the front upper beam and the front lower beam.

Patent Document 1: JP Patent No. 4897917

SUMMARY

However, as connectors become smaller, the space between the front upper beam and the base portion becomes smaller, and the incline of the front upper beam with the base portion serving as the support point becomes smaller. This reduces the contact pressure from the front upper beam and the front lower beam on the flat cable, and the flat cable can no longer be securely held by the connector.

In light of this situation, the present disclosure stably connects a flat cable to the terminals of a connector.

The present disclosure further provides a connector able to form a simple structure in which the actuator is kept from detaching from the housing and terminals when the actuator is being assembled in the housing with the terminals.

The present disclosure further keeps the actuator from detaching from the terminals after the actuator has been assembled with the terminals using a simple configuration.

The following is a brief summary of the disclosure of the present application.

(1) The present disclosure is a connector having terminals, an actuator, and a housing for the terminals, the connector being able to receive an inserted flat cable; each terminal including: a base portion extending vertically, a rear upper beam extending to the rear from the upper end of the base portion, a front upper beam extending forward from the upper end of the base portion, and extending downward at an angle to contact the flat cable when the rear upper beam is pushed upwards, a rear lower beam extending to the rear from the lower end of the base portion, and a front lower beam extending forward from the lower end of the base portion; the actuator having a cam arranged between the rear lower beam and the rear upper beam for pushing the rear upper beam upwards; the rear lower beam having a fixed portion on the rear end of the rear lower beam fixed to an external circuit board; and the front lower beam including: a contact point protruding upwards for establishing contact with the flat cable, and a front end of the lower surface of the front lower beam for establishing contact with the upper surface of the bottom portion of the housing, the contact point being positioned to the rear of the front end of the lower surface of the front lower beam, and the front lower beam and the rear lower beam curving upward when the rear upper beam is pushed upwards with the front end of the lower surface of the front lower beam and the fixed portion serving as the support point. Because more contact pressure is maintained on the flat cable than in a connector without this configuration, the present invention can stably connect a flat cable to the terminals of the connector.

(2) The present disclosure may be a connector according to (1), in which the housing is inclined so that the rear end of the bottom portion of the housing is positioned above the front end of the bottom portion of the housing when the rear upper beam is pushed upwards, and a gap allowing the housing to be inclined is formed between the upper surface rear end of the bottom portion of the housing and the rear lower beam.

(3) The present disclosure may be a connector according to (2), in which the gap extends at least from the rear end of the bottom portion of the housing to the cam and the bottom end of the base portion.

(4) The present invention may be a connector according to (2) or (3), in which the gap is configured by forming a recess in the upper surface of the bottom portion of the housing.

(5) The present disclosure is also a connector comprising: a housing, terminals housed inside the housing, and an actuator; the housing including: an accommodating portion having left and right side walls composing the left and right side surfaces of the housing, and a ceiling panel composing the upper surface of the housing, the accommodating portion accommodating the terminals, and left and right actuator holding portions extending to the rear of the accommodating portion from the left and right side walls; each terminal including: a rear upper beam extending to the rear, and a rear lower beam having a stopper having a protruding portion projecting upwards and extending to the rear below the rear upper beam; the actuator being arranged between the left and right actuator holding portions, and having left and right first temporary stopping portions protruding towards the cam portion arranged between the rear lower beam and the rear upper beam and towards the left and right actuator holding portions; and the actuator holding portions each including a second temporary stopping portion protruding towards the actuator, the second temporary stopping portions regulating the movement of the first temporary stopping portions to the rear when the first temporary stopping portions are in front of the second first temporary stopping portions, and a groove extending from the front end of the ceiling panel to the front end of the second temporary stopping portions being formed in front of the second temporary stopping portions. Because, unlike connectors without this configuration, the cam portion of the actuator is kept from moving to the rear when the cam portion is positioned between the terminal stopper and the rear upper beam, the connector can form a simple structure in which the actuator is kept from detaching from the housing and terminals when the actuator is being assembled in the housing with the terminals.

(6) The present disclosure may be a connector according to (6), in which the front end of the second temporary stopping portions can be seen inside the groove when the ceiling panel is viewed from above.

(7) The present disclosure is also a connector comprising: a housing, terminals housed inside the housing, and an actuator; the housing including: an accommodating portion having left and right side walls composing the left and right side surfaces of the housing, and a ceiling panel composing the upper surface of the housing, the accommodating portion accommodating the terminals, and left and right actuator holding portions extending to the rear of the accommodating portion from the left and right side walls; each terminal including: a rear upper beam extending to the rear, and a rear lower beam having a stopper having a protruding portion projecting upwards and extending to the rear below the rear upper beam; and the actuator having a cam portion arranged between the rear lower beam and the rear upper beam in front of the stopper, the actuator being arranged between the left and right actuator holding portions, the left and right actuator holding portions restricting upward movement. Because the present invention, unlike a connector without this configuration, does not require a component to keep the actuator from detaching from the terminals, the actuator can be kept from detaching from the terminals after the actuator has been assembled with the terminals using a simple configuration.

(8) The present disclosure may be a connector according to (7), in which the actuator includes first protruding portions projecting towards the actuator holding portions, and the actuator holding portions each include a second protruding portion projecting towards the actuator, upward movement of the actuator being restricted by the first protruding portions engaging the second protruding portions.

DETAILED DESCRIPTION OF THE PREFERRED EMBODIMENTS

Figure 1:
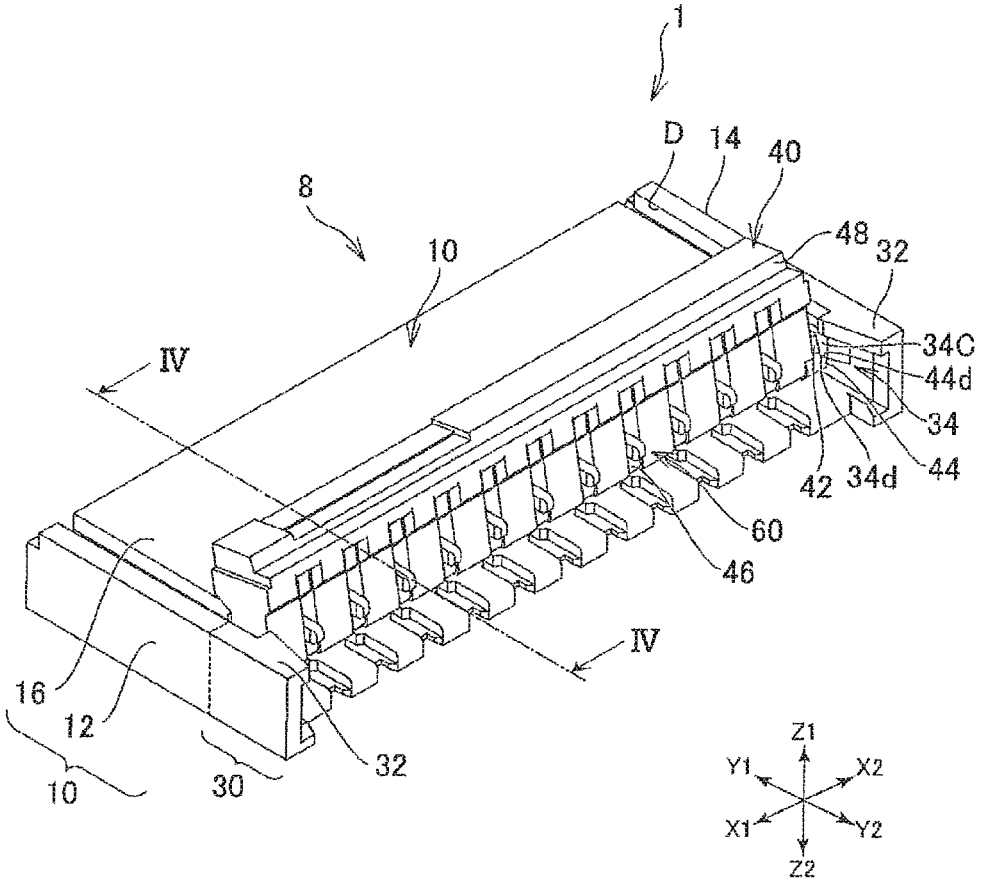
FIG. 1 is a perspective view showing a connector of the present disclosure.

The following is an explanation of the configuration of the connector in the present embodiment with reference to the drawings. In the drawings referenced in the following explanation, some portions exhibiting a certain characteristic may be enlarged to better explain that characteristic, and the dimensional ratios of the various configuration elements may not be the same as the actual dimensional ratios. The materials mentioned in the following explanation are merely examples, and may be different in each configurational element. These aspects can be modified without departing from the spirit and scope of the present disclosure.

Figure 2:
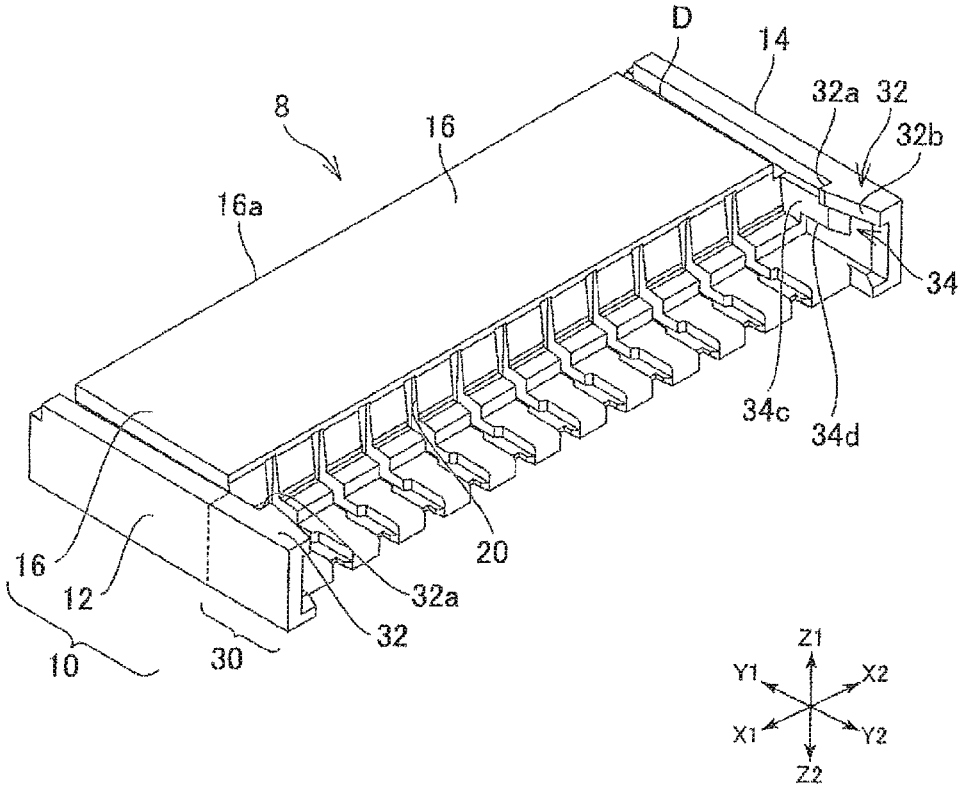
FIG. 2 is a perspective view of the housing shown in FIG. 1.
Figure 3:
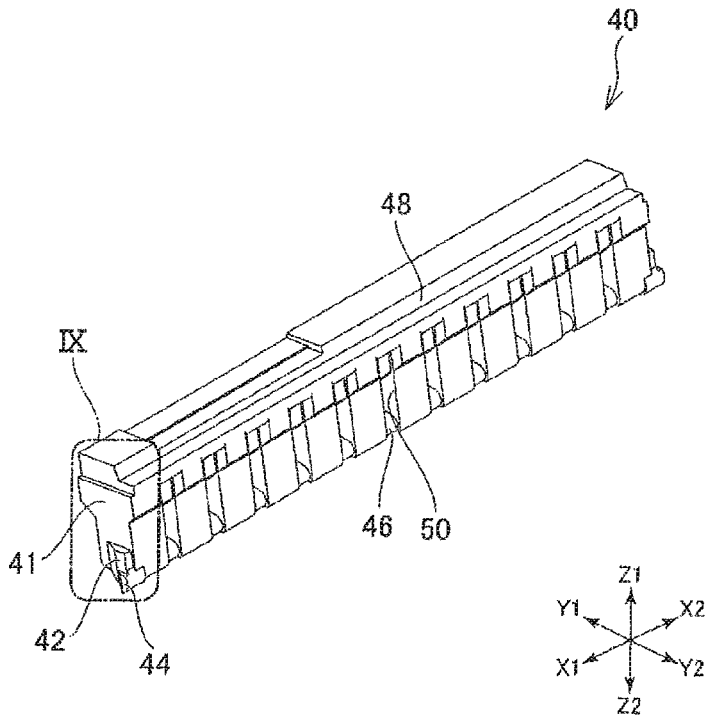
FIG. 3 is a perspective view of the actuator shown in FIG. 1.
Figure 4:
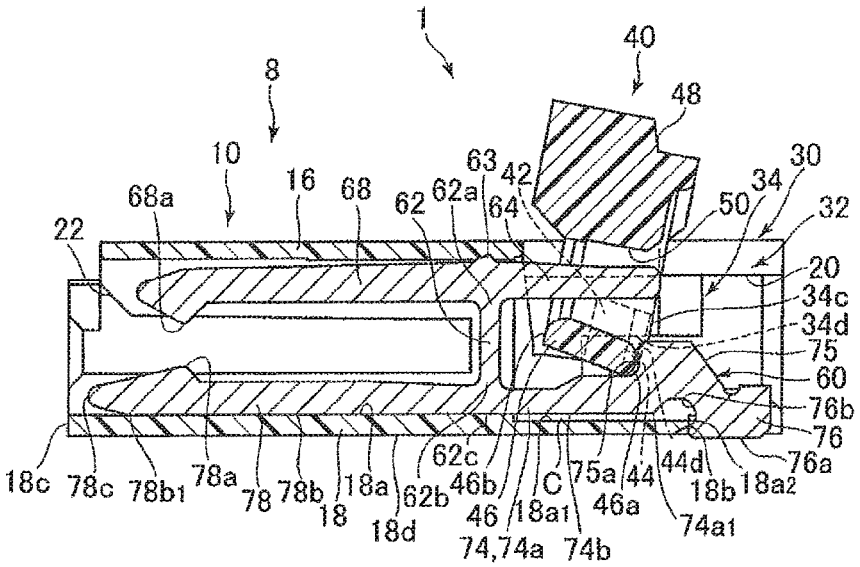
FIG. 4 is a cross-sectional view of the connector from IV-IV in FIG. 1.
Figure 4:
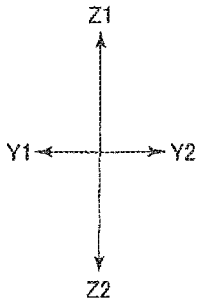
Figure 5:
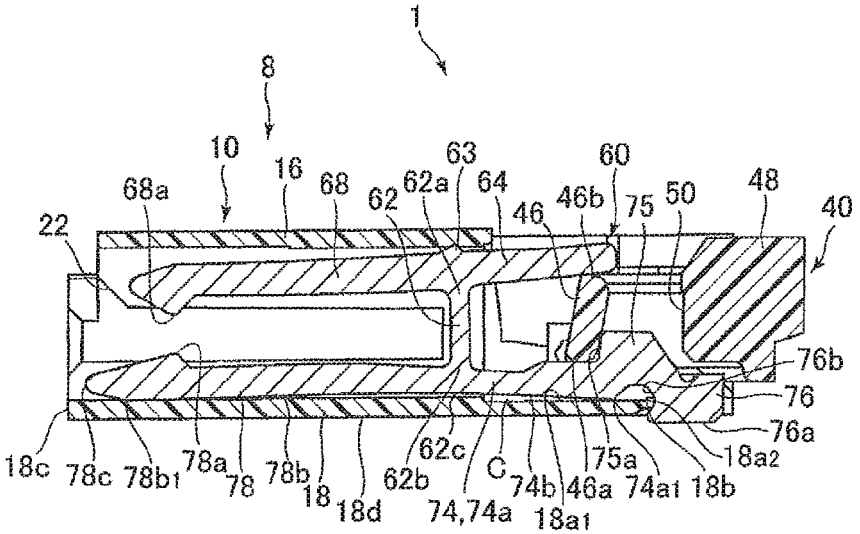
FIG. 5 is a cross-sectional view showing the actuator in the connector shown in FIG. 4 after it has rotated.
Figure 5:
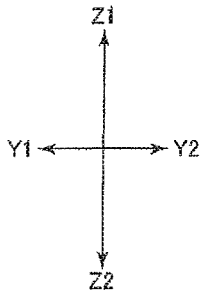

FIG. 1 is a perspective view showing a connector 1 of the present disclosure, FIG. 2 is a perspective view of the housing 8 shown in FIG. 1, FIG. 3 is a perspective view of the actuator 40 shown in FIG. 1, FIG. 4 is a cross-sectional view of the connector 1 from IV-IV in FIG. 1, and FIG. 5 is a cross-sectional view showing the actuator 40 in the connector 1 shown in FIG. 4 after it has rotated.

The connector 1 in the present embodiment is a connector able to receive an inserted flat cable such as an FPC or FFC. As shown in FIG. 1 and FIG. 4, the connector 1 has terminals 60, an actuator 40, and a housing 8 for accommodating the terminals 60. The following is a detailed explanation of each of these elements.

In the following explanation, the direction in which the side surfaces of the housing (side walls 12, 14 in the accommodating portion 10 described below) are arranged in FIG. 1 is the traverse direction (directions X1 and X2), the direction in which the upper surface (the ceiling panel 16 described below) of the housing 8 is arranged is the upward direction (direction Z1), the opposing direction is the downward direction (direction Z2), the direction in which the actuator 40 is arranged is the rearward direction (direction Y2), and the opposite direction is the forward direction (direction Y1). The Y directions (Y1, Y2) and the X directions (X1, X2) are orthogonal to the plan view (the angle viewed from direction Z1).

The housing 8 is formed from an insulator such as a resin and, as shown in FIG. 2, has an accommodating portion 10 for accommodating the terminals 60, and left and right actuator holding portions 30.

As shown in FIG. 2 and FIG. 4, the accommodating portion 10 has side walls 12, 14 constituting the side surfaces of the housing 8 in the traverse direction (directions X1 and X2), a ceiling panel 16 constituting the upper surface of the housing 8, and a bottom portion 18 constituting the lower surface of the housing 8. Also, as shown in FIG. 2, the housing 8 has left and right actuator holding portions 30 extending in the rearward direction (Y2 direction) of the accommodating portion 10 from the left and right side walls 12, 14.

The actuator holding portions 30 hold the actuator 40 between the left and right actuator holding portions 30. As shown in FIG. 2, the actuator holding portions 30 each have a second temporary stopping portion 32 and a second protruding portion 34 projecting towards the actuator 40. These elements will be described below when appropriate.

As shown in FIG. 4, an opening 20 for receiving inserted terminals 60 is provided in the housing 8 in the rear (Y2 direction), and an opening 22 for receiving an inserted flat cable (not shown) is provided in the front (Y1 direction).

The actuator 40 is a component that elastically deforms the terminals 60 and is made, for example, of a resin. As shown in FIG. 2 and FIG. 4, the actuator 40 is arranged between the left and right actuator holding portions 30.

As shown in FIG. 3 and FIG. 4, the actuator 40 has a cam portion 46, an operating portion 48, a hole portion 50 passing through in the longitudinal direction (Y1 and Y2 direction), and first temporary stopping portions 42 and first protruding portions 44 projecting towards the actuator holding portions 30 (on the X1 and X2 sides). The explanation of each of the elements of the actuator 40 will be combined with the explanation of the terminals 60, but the first temporary stopping portions 42 and the first protruding portions 44 will be explained below when appropriate.

As shown in FIG. 4, each terminal 60 has a base portion 62 extending in the vertical direction (the Z1 and Z2 directions), a rod-like rear upper beam 64 extending to the rear (in the Y2 direction) from the upper end 62*a* of the base portion 62, a rod-like front upper beam 68 extending forward (in the Y2 direction) from the upper end 62*a* of the base portion 62, a rod-like rear lower beam 74 extending to the rear (in the Y2 direction) from the lower end 62*b* of the base portion 62, and a rod-like front lower beam 78 extending forward (in the Y1 direction) from the lower end 62*b* of the base portion 62.

The base portion 62 connects the upper beams (the rear upper beam 64 and the front upper beam 68) and the lower beams (the rear lower beam 74 and the front lower beam 78). The boundary between the base portion 62 and the upper beams (the rear upper beam 64 and the front upper beam 68) (upper end of the base portion 62 extending vertically) is the upper end 62*a*, and the boundary between the base portion 62 and the lower beams (the rear lower beam 74 and the front lower beam 78) (lower end of the base portion 62 extending vertically) is the lower end 62*b*.

A tab portion 63 protruding upward (in the Z1 direction) is formed upward in the base portion 62, and this tab portion 63 is hooked by the ceiling panel 16 of the housing 8 as shown in FIG. 4 to secure the terminals 60 in the housing 8.

The rear upper beam 64 is pushed upwards (in the Z1 direction) by the cam portion 46 of the actuator 40. The rear upper beam 64 is fitted into the hole portion 50 provided in the actuator 40.

The rear lower beam 74 is positioned below the rear upper beam 64 (in the Z2 direction) and is oriented in the upward direction with the rear upper beam 64 (in the Z1 and Z2 directions). The rear lower beam 74 has a straight section 74*a* spanning the lower surface 74*b* in the longitudinal direction (in the Y1 and Y2 directions), a protruding stopper 75 projecting upward (in the Z1 direction), and a fixed portion 76 secured to an external circuit board (not shown).

The stopper 75 is provided to the rear of the straight section 74*a* (in the Y2 direction). The stopper 75 is positioned to the rear of the cam portion 46 of the actuator 40 (in the Y2 direction), and the rear end (lower end) 46*a* of the cam portion 46 is positioned in the front surface 75*a* of the stopper 75.

The fixed portion 76 is provided to the rear of the stopper 75 (in the Y2 direction). The fixed portion 76 has a shape that curves downward (in the Z2 direction) from the rear end 74*a*1 of the straight section 74*a*, and the fixed portion 76 is positioned to the rear of the rear end 18*b* of the bottom portion 18 of the housing 8 (in the Y2 direction).

The bottom surface 76*a* of the fixed portion 76 is positioned below the lower surface 18*d* of the bottom portion 18 (in the Z2 direction). As a result, the upper surface 76*b* of the fixed portion 76 is positioned to the rear of the rear end 18*b* of the bottom portion 18 (in the Y2 direction) and movement in the forward direction of the terminals 60 (in the Y1 direction) is restricted. The bottom surface 76*a* of the fixed portion 76 is secured to the circuit board (not shown) using solder.

Also, as shown in FIG. 4, a gap C is preferably formed between the rear lower beam 74 and the upper surface 18*a* of the bottom portion 18 of the housing 8. More specifically, the upper surface 18*a*1 of the bottom portion 18 and the lower surface 74*b* of the rear lower beam 74 are separated where the lower surface of the rear lower beam 74 is lower surface 74*b* and the upper surface of the bottom portion 18 positioned below the rear lower beam 74 is the upper surface 18*a*1. The size and position of this gap C will be explained below when appropriate.

The cam portion 46 of the actuator 40 is arranged between the rear lower beam 74 and the rear upper beam 64. The cam portion 46 rotating between the rear upper beam 64 and the rear lower beam 74 pushes the rear upper beam 64 upwards (in the Z1 direction). The operation of the rotating cam portion 46 will be explained below when appropriate.

The rear upper beam 68 is oriented downwards (in the Z2 direction) and comes into contact with the flat cable when the rear upper beam 64 is pushed upwards (in the Z1 direction). The front upwards beam 68 has a contact point 68*a* protruding downwards (in the Z2 direction). The contact point 68*a* makes contact with the upper surface of the flat cable when the flat cable (not shown) has been inserted into the housing 8 and the cam portion 46 has pushed the rear upper beam 64 upwards.

The flat cable is interposed between the front upper beam 68 and the front lower beam 78. The front lower beam 78 has a contact point 78*a* projecting upwards (in the Z1 direction). The contact point 78*a* makes contact with the lower surface of the flat cable when the flat cable (not shown) has been inserted into the housing 8.

The lower surface 78*b* of the front lower beam 78 comes into contact with the upper surface 18*a* of the bottom portion 18 of the housing 8. When the front end of the rear lower beam 78 is the front end 78*c*, the front end 78*b*1 is positioned to the rear of the front end 78*c* (in the Y2 direction), and the contact point 78*a* is positioned to the rear of the front end 78*b*1 (in the Y2 direction).

In the present embodiment, front end 78*b*1 is the front end of the lower surface 78*b* of the front lower beam 78 that establishes contact with the upper surface 18*a* of the bottom portion 18. In other words, the front end 78*b*1 is the boundary between the portion of the lower surface 78*b* making contact with the upper surface 18*a* of the bottom portion 18, and the portion of the lower surface 78*b* not making contact with the upper surface 18*a* of the bottom portion 18.

The following is a more detailed explanation of the operations performed by the terminals 60 when the rear upper beam 64 of the terminals 60 has been pushed upwards (in the Z1 direction) by the cam portion 46 of the actuator 40. When the operator moves the operating portion 48 of the actuator 40 downward to the rear (in the Y2 direction) of the position shown in FIG. 4, the cam portion 46 rotates between the rear upper beam 64 and the rear lower beam 74 as shown in FIG. 5.

The width of the cam portion 46 from the rear end 46*a* to the front end 46*b* is greater than the gap between the rear upper beam 64 and the rear lower beam 74. Thus, when the cam portion 46 is rotated with the rear end 46*a* serving as the support point, the front end 46*b* moves upwards (in the Z1 direction) and pushes the rear upper beam 64 upwards (in the Z1 direction).

By pushing the rear upper beam 64 upwards (in the Z1 direction), the downward force (in the Z2 direction) with the rear end 62*a* of the base portion 62 serving as the support point acts on the front upper beam 68. This, as shown in FIG. 4 and FIG. 5, causes the front upper beam 68 to tilt downwards (in the Z2 direction).

Also, the force pushing the rear upper beam 64 upwards (in the Z1 direction) is transmitted via the base portion 62 to the rear lower beam 74. Because the bottom surface 76*a* of the fixed portion 76 of the rear lower beam portion 74 is fixed to the circuit board (not shown), the force lifting the rear lower beam 74 (in the Z1 direction) acts on the front portion of the fixed portion 76 (in the Y1 direction). As a result, the rear lower beam 74 reacts by moving upwards (in the Z direction) with the rear end 62*b* of the base portion 62 serving as the point of action while the bottom surface 76*a* of the fixed portion 76 serves as the support point.

Similarly, when the rear upper beam 64 is pushed upwards (in the Z1 direction) by the cam portion 46, the counterclockwise moment of all of the terminals 60 (that is, counterclockwise in FIG. 4 and FIG. 5) acts on the front lower beam 78. However, because the fixed portion 76 is fixed to the circuit board (not shown), the base portion 62 tilts to the rear (in the Y2 direction). This causes the front lower beam 78 and the rear lower beam 74 to (react and) curve upwards (in the Z1 direction).

In this way, the front (Y1) side of the front lower beam 78 is pushed downwards (in the Z2 direction), and the front lower beam 78 causes the lower end 62*b* of the base portion 62 to curve upwards (in the Z1 direction) with the front end 78*b*1 of the lower surface 78*b* serving as the support point.

Therefore, because the rear lower beam 64 is pushed upwards (in the Z1 direction) by the cam portion 46 in the connector 1 of the present invention, the lower surface 62*c* at the lower end 62*b* of the base portion 62 is curved so as to be positioned above the front end 78*b*1 of the lower surface 78*b* of the front lower beam 78 and the lower surface 76*a* of the fixed portion 76 of the rear lower beam 74 (in the Z1 direction).

This causes the lower beams (the rear lower beam 74 and the front lower beam 78) of the terminals 60 to curve upwards (in the Z1 direction) with the front end 78*b*1 of the lower surface 78*b* of the front lower beam 78 and the fixed portion 76 of the rear lower beam 74 serving as support points.

As a result, in the connector 1, the portion of the rear lower beam 74 between the front end 78*b*1 of the lower surface 78*b* and the fixed portion 76 of the rear lower beam 74 is positioned higher (in the Z1 direction) than the same portion in connectors without this configuration. Also, because the contact point 78*a* of the front lower beam 78 is positioned to the rear of the front end 78*b*1 (in the Y2 direction), the curvature causes the position of the contact point 78*a* to be higher (in the Z1 direction) than in connectors without this configuration.

Therefore, the gap between the contact point 78*a* of the front lower beam 78 of the connector 1 and the contact point 68*a* of the front upper beam 68 is smaller than the same gap in a connector without this configuration. As a result, the contact pressure on the flat cable from the front upper beam 68 and the front lower beam 78 is greater, and the flat cable can be secured more reliably by the connector 1.

In the connector 1 of the present embodiment, the configuration maintains contact pressure on the flat cable even when the size of the connector 1 is reduced. As a result, a smaller connector 1 can be realized.

In the connector 1 of the present embodiment, as shown in FIG. 5, the bottom surface 76*a* of the rear lower beam 74 is secured to a circuit board (not shown), and the terminals 60 are secured in the housing 8 by the tab portion 63. As a result, when the rear upper beam 64 is pushed upwards (in the Z1 direction), the counterclockwise moment of all of the terminals 60 (that is, counterclockwise in FIG. 4 and FIG. 5) acts on the housing 8 at or near the tab portion 63.

In this way, the rear end 18*b* of the bottom portion 18 of the housing 8 is inclined so as to be higher (in the Z1 direction) than the front end 18*c* of the bottom portion 18 of the housing. Because in the connector 1 of the present embodiment a gap C is provided between the rear lower beam 74 and the upper surface 18*a* of the bottom portion 18 of the housing 8, inclination of the housing 8 is permitted by the gap C.

The rear end of the gap C in the present embodiment is between the rear end 74*a*1 of the straight section 74*a* of the rear lower beam 74 and the upper surface 18*a*1 of the bottom portion 18, and the gap C does not include the curved portion of the rear lower beam 74 (the curved portion extending from the front surface 76*b* of the fixed portion 76 and the rear end 74*a*1 of the straight section 74*a*). Therefore, the gap C is formed in the forward direction (in the Y1 direction) from the rear end 74*a*1 of the straight section 74*a*. Note that the gap C should be provided between at least the rear end 74*a*1 of the straight section 74*a* and the upper surface 18*a*1 of the bottom portion 18.

To explain the relationship between the inclination of the housing 8 and the gap C in greater detail, the inclination of the bottom portion 18 of the housing 8 moves the rear end 18*a*2 of the upper surface 18*a* of the bottom portion 18 upwards. Here, the gap C can be provided so that the upper surface 18*a* of the bottom portion 18 can incline into the gap C. Compared to a connector without a gap C, the connector 1 in the present embodiment relieves restrictions on the inclination of the bottom portion 18 caused by the upper surface 18*a* of the bottom portion 18 coming into contact with the lower surface 74*b* of the rear lower beam 74. As a result, the inclination of the housing 8 can be increased.

By increasing the inclination of the housing 8 in this manner, restrictions on the inclination of the rear upper beam 64 caused by contact between the rear upper beam 64 and the housing 8 can be relieved. Therefore, in contrast to a connector without this configuration, the inclination of both the rear upper beam 64 and the rear upper beam 68 can be increased.

By increasing the inclination of both the rear upper beam 64 and the front upper beam 68, the force acting on the rear lower beam 74 and the front lower beam 78 can be increased via the base portion 62. Also, by providing a gap C, restrictions on the curvature of the rear lower beam 74 caused by the rear end 74*a*1 of the rear lower beam 74 coming into contact with the upper surface 18*a*1 of the bottom portion 18 can be relieved.

As a result, the difference between the height of the lower surface 62*c* of the lower end 62*b* of the base portion 62 and the heights of the front end 78*b*1 of the lower surface 78*b* of the front lower beam 78 and the lower surface 76*a* of the fixed portion 76 of the rear lower beam 74 can be increased compared to the difference in a connector without this configuration. In other words, the front lower beam 78 and the rear lower beam 74 can curve more.

Compared to a connector without this configuration, the connector 1 of the present invention can reduce the gap between the contact point 78*a* of the front lower beam 78 and the contact point 68*a* of the front upper beam 68 in the connector. As a result, the flat cable is secured more reliably by the connector 1, and a smaller connector 1 can also be realized.

As shown in FIG. 5, the gap C preferably extends forward at least from the rear end 18*b* of the bottom portion 18 of the housing to the space between the cam portion 46 and the lower end 62*b* of the base portion 62. By extending the gap C in this way, the restrictions on the inclination of the housing 8 are relaxed.

As a result, the inclination of the housing 8 can be increased, and the curvature of the front upper beam 68, the rear upper beam 64, the front lower beam 78 and the rear lower beam 74 can be increased. As a result, the flat cable is secured more reliably by the connector 1, and a smaller connector 1 can also be realized.

When the front lower beam 78 and the rear lower beam 74 curve, the rear lower beam 74 extends rearward (in the Y2 direction) and downward (in the Z2 direction) from the base portion 62. When the front lower beam 78 and the rear lower beam 74 are curved, interference between the rear lower beam 74 and the bottom portion 18 of the housing 8 is avoided, and the gap C can extend more preferably to the rear of the lower end 62*b* of the base portion 62 (in the Y2 direction).

More specifically, the front end of the gap C is preferably positioned to the rear of the lower end 62*b* of the base portion 62 (in the Y2 direction), but near the lower end 62*b*. This configuration allows the inclination of the housing 8 to be maximized, and can increase the curvature of the front upper beam 68, the rear upper beam 64, the front lower beam 78, and the rear lower beam 74.

The length of the gap C in the longitudinal direction (in the Y1 and Y2 directions), the depth in the downward direction (in the Z2 direction), the strength of the housing 8, and the desired curvature width of each beam can be set as desired.

The lower surface 78*b* of the front lower beam 78 and the lower surface 74*b* of the rear lower beam 74 preferably have a linear cross-sectional profile in the longitudinal direction (in the Y1 and Y2 directions). This configuration allows the curvature of both beams (the front lower beam 78 and the rear lower beam 74) to be uniform.

As shown in FIG. 5, the gap C is preferably formed by creating a recess in the upper surface 18*a* of the bottom portion 18 of the housing 8. This configuration is able to achieve the effects of the present invention while also retaining the linear profile and strength of the lower surface 74*b* of the rear lower beam 74.

The gap C is preferably formed by creating a recess in the upper surface 18*a* of the bottom portion 18, but may also be formed by creating a recess in the lower surface 74*b* of the rear lower beam 74 in the upward direction (in the Z1 direction).

The following is a detailed explanation, with reference to the drawings, of the configuration of the first temporary stopping portions 42 and the first protruding portions 44 of the actuator 40, and the second temporary stopping portions 32 and the second protruding portions 34 of the actuator holding portions 30, and a detailed explanation of the actions of these components when the actuator 40 is mounted in the housing 8.

Figure 6:
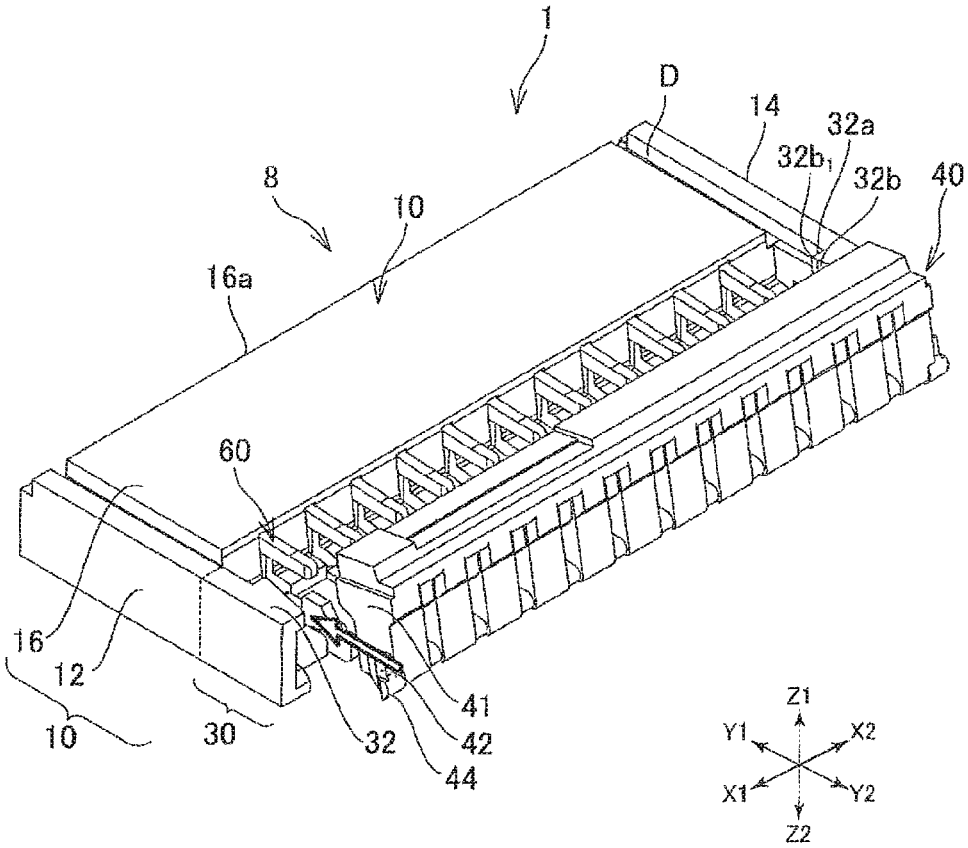
FIG. 6 is a perspective view of the operation for mounting the actuator in the housing from the same direction as FIG. 1.
Figure 7A:
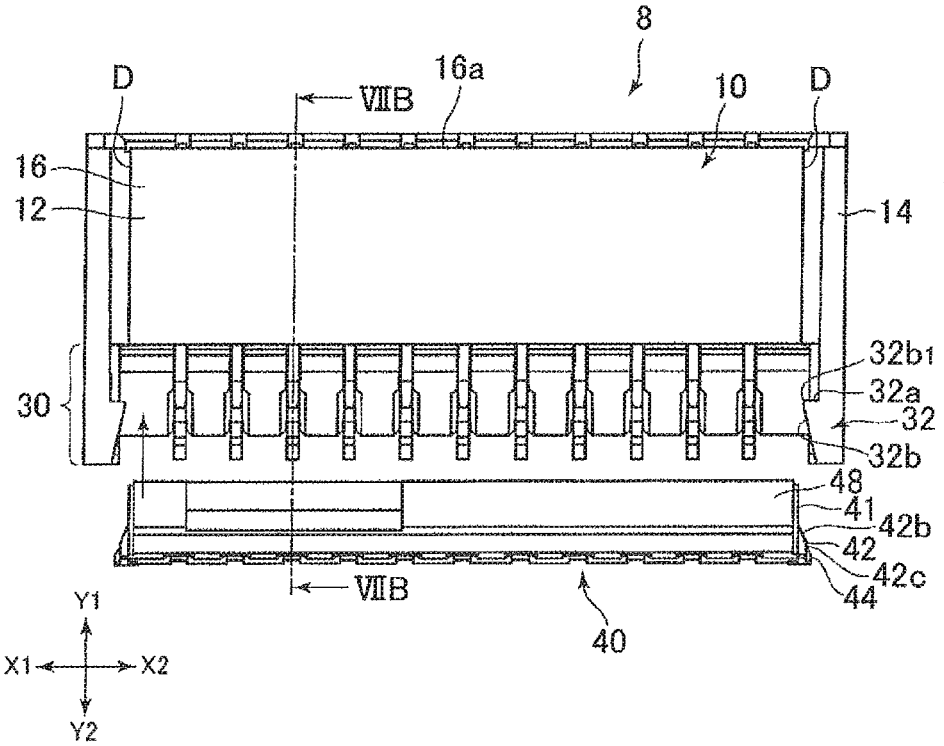
FIG. 7A is a plan view showing the housing and the actuator in FIG. 6 from above.
Figure 7B:
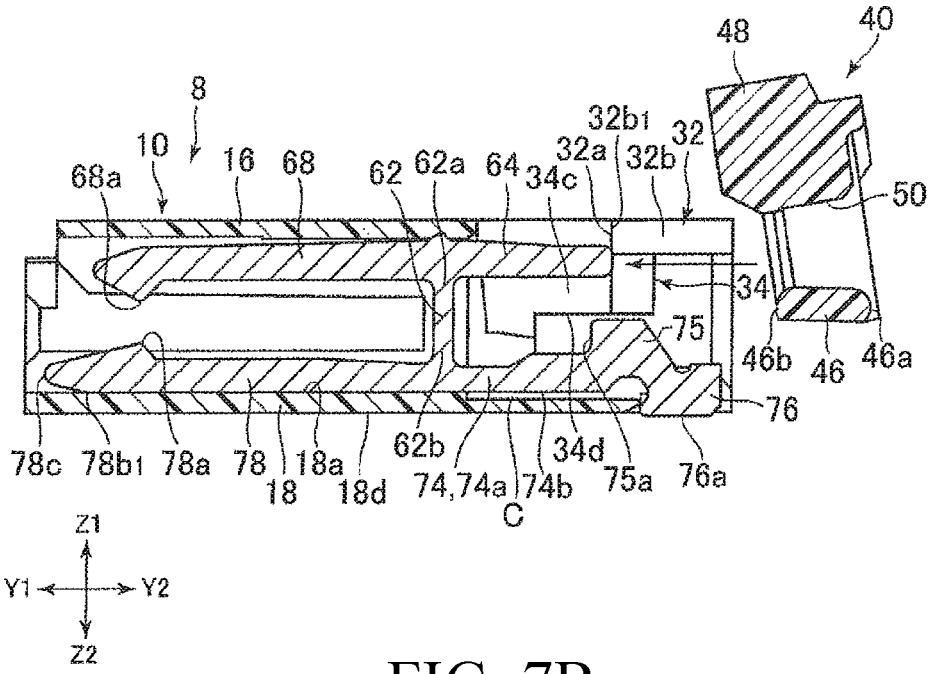
FIG. 7B is a cross-sectional view of the housing and the actuator from VIIB-VIIB in FIG. 7A.
Figure 8A:
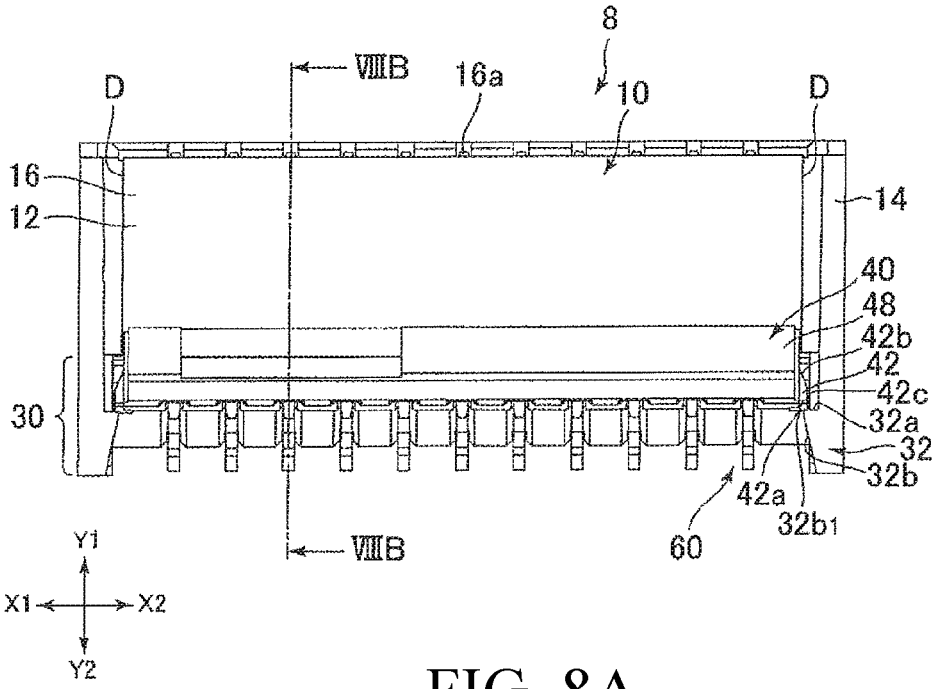
FIG. 8A is a plan view of the operation for mounting the actuator in the housing from the same direction as FIG. 7A.
Figure 8B:
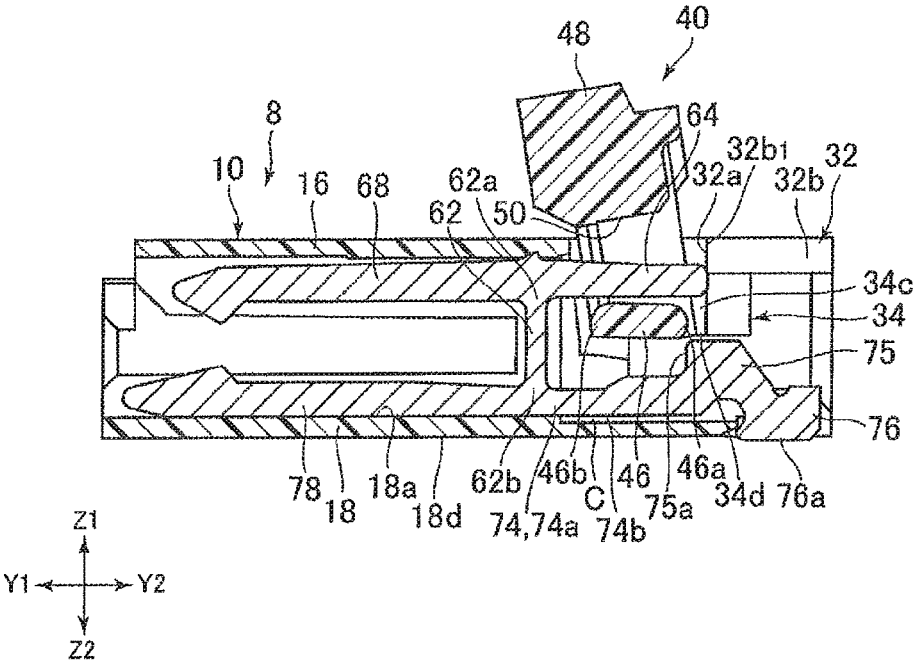
FIG. 8B is a cross-sectional view of the housing and the actuator from VIIIB-VIIIB in FIG. 8A.
Figure 9:
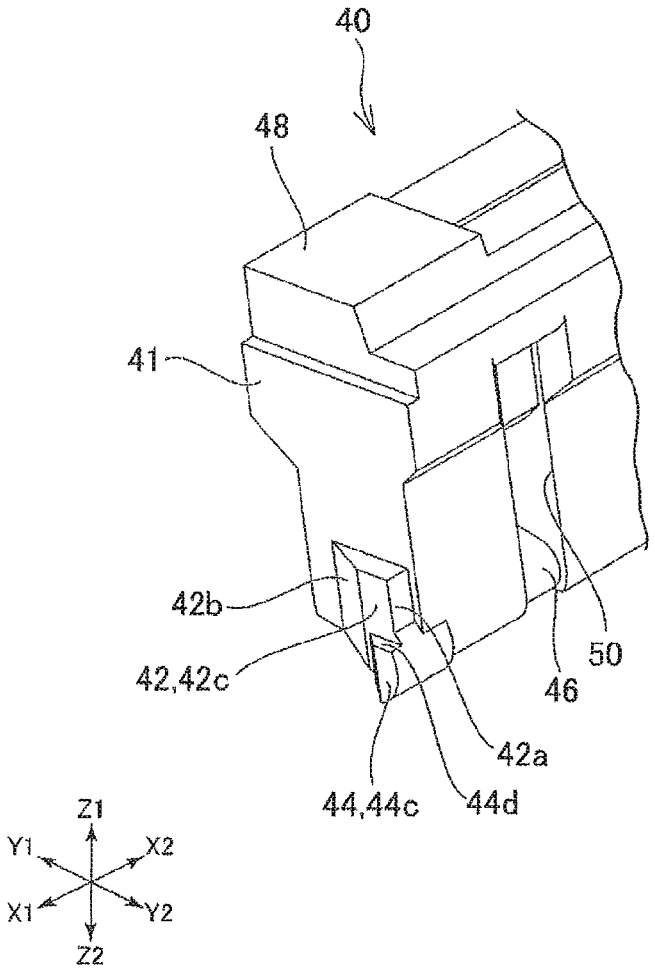
FIG. 9 is a partially enlarged view of area IX of the actuator shown in FIG. 3.

FIG. 6 is a perspective view of the operation for mounting the actuator 40 in the housing 8 from the same direction as FIG. 1, FIG. 7A is a plan view showing the housing 8 and the actuator 40 in FIG. 6 from above, FIG. 7B is a cross-sectional view of the housing 8 and the actuator 40 from VIIB-VIIB in FIG. 7A, FIG. 8A is a plan view of the operation for mounting the actuator 40 in the housing 8 from the same direction as FIG. 7A, FIG. 8B is a cross-sectional view of the housing 8 and the actuator 40 from VIIIB-VIIIB in FIG. 8A, FIG. 9 is a partially enlarged view of area IX of the actuator 40 shown in FIG. 3.

The method of mounting the actuator 40 in the housing 8 includes the steps of arranging the actuator 40 so that the cam portion 46 can pass between the stopper 75 and the rear upper beam 64, and moving the actuator 40 forward (in the Y1 direction). The actuator 40 is inserted into the terminals 60, as shown in FIG. 1 and FIG. 4, by moving the actuator 40 forwards (in the Y1 direction) and then downwards (in the Z2 direction). Each configuration and the actions performed by each configuration in each step will now be explained in sequential order.

First, the configurations of the first temporary stopping portions 42 and the first protruding portions 44 of the actuator 40, and the second temporary stopping portions 32 and second protruding portions 34 of the actuator holding portions 30 will be explained in detail.

As shown in FIG. 6 and FIG. 9, the first temporary stopping portions 42 and the first protruding portions 44 are provided in the traverse direction (the X1 and X2 directions) of the actuator 40 and project towards the actuator holding portions 30.

As shown in FIG. 9, the first temporary stopping portions 42 have a protruding profile and project from the side surfaces 41 of the actuator 40 towards the actuator holding portions 30 (in the X1 direction in FIG. 9). The first temporary stopping portions 42 engage the second temporary stopping portions 32 of the actuator holding portions 30 when the actuator 40 is mounted, and this restricts movement of the actuator 40 to the rear (in the Y2 direction).

When the rear surface of first temporary stopping portions 41 (in the Y2 direction) is the first rear surface 42*a*, and the front surface (in the Y1 direction) is the front surface 42*b*, the angle formed by the front surface 42*b* and the side surface 41 is preferably smaller than the angle formed by the first rear surface 42*a* and the side surface 41. More specifically, the angle formed by the front surface 42*b* and the side surface 41 is an acute angle when the actuator 40 is viewed from above (the Z1 direction).

This configuration relieves the restrictions on the movement of the actuator 40 in the forward direction (in the Y1 direction) caused by the front surface 42*b* of the first temporary stopping portions 42 coming into contact with the second temporary stopping portions 32. As a result, the first temporary stopping portions 42 easily engage with the second temporary stopping portions 32.

The first protruding portions 44 are provided below the first temporary stopping portions 42 (in the Z2 direction). The first protruding portions 44 engage the second protruding portions 34 of the actuator holding portions 30. The first protruding portions 44 have a protruding profile and project towards the actuator holding portions 30 from the side surfaces 41 of the actuator 40.

The surface 44*c* of the first protruding portions 44 on the actuator holding portion 30 side (the surface on the X1 side in FIG. 9) is positioned closer to the actuator holding portions 30 than the surface 42*c* of the first temporary stopping portions 42 on the actuator holding portion 30 side.

When the upper surface (in the Z1 direction) of the first protruding portions 44 is the upper surface 44*d*, the angle formed by the upper surface 44*d* and the surface 42*c* of the first temporary stopping portions 42 is preferably a right angle. This configuration enables the upper surface 44*d* of the first protruding portions 44 to more readily engage the lower surface 34*d* of the second protruding portions 34, and prevent slippage of the actuator 40 in the upward direction (in the Z1 direction).

As shown in FIG. 2 and in FIG. 7A and FIG. 7B, second temporary stopping portions 32 and second protruding portions 34 are provided on the side surfaces of the actuator holding portions 30 on the actuator 40 side so as to protrude towards the actuator 40.

As shown in FIG. 2, the second temporary stopping portions 32 have a protruding profile and project from the actuator holding portions 30 towards the actuator 40. The second temporary stopping portions 32 engage the first temporary stopping portions 42 of the actuator 40 when the actuator 40 is mounted in the connector, and this restricts movement of the actuator 40 to the rear (in the Y2 direction).

As shown in FIG. 2 and FIG. 7A, when the front end of the second temporary stopper portions 32 is the front end (front surface) 32*a* and the side surface to the rear of the front end 32*a* (in the Y2 direction) is the inclined surface 32*b*, the angle formed by the inclined surface 32*b* and the side walls 12, 14 is preferably an acute angle when the housing 8 is viewed from above (in the Z1 direction).

This configuration relaxes the restriction on the forward movement of the actuator 40 caused by the front surface 42*b* of the first temporary stopping portions 42 coming into contact with the inclined surface 32*b* of the second temporary stopping portions 32. As a result, the first temporary stopping portions 42 more easily engage the second temporary stopping portions 32.

Next, the actions of the first temporary stopping portions 42 and the second temporary stopping portions 32 will be explained when the actuator 40 is arranged so that the cam portion 46 can pass between the stopper 75 and the rear upper beam 64, and when the actuator 40 moves forward (in the Y1 direction). First, as shown in FIG. 6, the vertical position of the actuator 40 relative to the first temporary stopping portions 42 (in the Z1 and Z2 directions) is aligned with the vertical position of the housing 8 accommodating the terminals 60 relative to the second temporary stopping portions 32.

Next, as shown in FIG. 6, FIG. 7A and FIG. 7B, the actuator 40 is moved in the direction of the arrow (in the Y1 direction). Then, as shown in FIG. 8A, the rear end (rear surface) 42*a* of the first temporary stopping portions 42 is arranged in front of the front end 32*a* (front surface) of the second temporary stopping portions 32 (in the Y1 direction). This, as shown in FIG. 8B, arranges the cam portion 46 in front of (in the Y1 direction) and above (in the Z1 direction) the stopper 75 of the terminals 60, and below (in the Z2 direction) the rear upper beam 64.

When the actuator 40 is moved in this manner, the gap between the inclined surfaces 32*b* of the left and right second temporary stopping portions 32 is smaller than the gap between the left and right surfaces 42*c* of the first temporary stopping portions 42. As a result, the inclined surfaces 32*b* of the second temporary stopping portions 32 come into contact with the front surfaces 42*b* of the first temporary stopping portions 42 (so as to maintain contact pressure).

In the actuator 40, the first temporary stopping portions 42 slide into the inclined surfaces 32*b* of the second temporary stopping portions 32 when the rear end 42*a* of the first temporary stopping portions 42 has moved in front of the front end 32*a* of the second temporary stopping portions 32 (in the Y1 direction). During this movement, the actuator 40 may become curved by the contact pressure between the second temporary stopper portions 32 and the first temporary stopping portions 42.

As shown in FIG. 8A and FIG. 8B, the movement of the rear end 42*a* of the first temporary stopping portions 42 in front of the front end 32*a* of the second temporary stopping portions 32 (in the Y1 direction) separates the inclined surface 32*b* of the second temporary stopping portions 32 from the front surface 42*b* of the first temporary stopping portions 42, and releases the contact pressure applied to the actuator 40.

In this way, the width of the actuator 40 in the traverse direction (in the X1 and X2 directions) returns to the width prior to the application of contact pressure, and the surface 42*c* of the first temporary stopping portions 42 on the actuator holding portion 30 side moves to the outside of the rear end 32*b*1 of the inclined surface 32*b* of the second temporary stopping portions 32 (in the X1 and X2 directions).

As a result, the rear end 42*a* of the first temporary stopping portions 42 and the front end 32*a* of the second temporary stopping portions 32, as shown in FIG. 8A, overlap at least partially in the longitudinal direction (the Y1 and Y2 directions) in plan view (when viewed from the Z1 direction), and movement towards the rear of the first temporary stopping portions 42 (in the Y2 direction) is restricted.

In the connector 1 of the present embodiment, as mentioned above, movement to the rear of the first temporary stopping portions 42 (in the Y2 direction) is restricted when the first temporary stopping portions 42 are in front of the second temporary stopping portions 32 (in the Y1 direction).

As a result, movement of the cam portion 46 to the rear (in the Y2 direction) is restricted when the cam portion 46 of the actuator 40 is between the stopper 75 of the terminals 60 and the rear upper beam 64. In this way, the cam portion 46 is kept from detaching from the terminals 60 when the actuator 40 temporarily stops in the housing 8.

In the connector 1 of the present embodiment, as shown in FIG. 6 and FIG. 8A, a groove D is formed in front of the second temporary stopping portions 32 (in the Y1 direction) and extends from the front end 16*a* of the ceiling panel 16 to the front end 32*a* of the second temporary stopping portions 32 in the longitudinal direction (in the Y1 and Y2 directions). This groove D is created when the second temporary stopping portions 32 are formed.

When the housing 8 is molded, the second temporary stopping portions 32 are arranged in the molding plate so that the front ends 32*a* of the secondary temporary stopping portions 32 are in the desired position. Because the rear end of the molding plate (the end in direction Y2 in the drawing) is arranged so as to be aligned with the front ends 32*a*, a groove D is formed in the molded ceiling panel 16 in the position corresponding with the molding plate, and the groove extends in the longitudinal direction from the front end 16*a* of the ceiling plate 16 to the front end 32*a* of the second temporary stopping portions 32.

By forming a groove D in this manner, the front ends 32*a* of the second temporary stopping portions 32 can be seen inside the groove D when viewed from the front of the ceiling plate (in the Y1 direction).

Because the connector 1 in the present embodiment has this configuration, the second temporary stopping portions 32 can be molded using two molding plates, namely, a molding plate used to form the front end 32*a* of the second temporary stopping portions 32 and a molding plate used to form the inclined surface 32*b* of the second temporary stopping portions 32. In the prior art, three or more molding plates are required to form temporary stopping portions in a housing 8. Because the connector 1 of the present embodiment has this configuration, the steps performed to mold the configuration required to perform the temporary stopping operation can be simplified and any type of molding plate that is required can be used. As a result, the costs associated with molding the connector 1 can be held down.

In the connector 1 of the present embodiment, the second temporary stopping portions 32 can also be molded using a single molding plate extending in the longitudinal direction (in the Y1 and Y2 directions). As a result, the molding plate used to form the openings 20, 22 in the housing can be used to form the second temporary stopping portions 32. Therefore, the steps required to form the second temporary stopping portions 32 and the type of molding plate used can be simplified.

Because the second temporary stopping portions 32 are integrally formed with the ceiling panel 16 in the connector 1 of the present embodiment, the second temporary stopping portions 32 are stronger than in connectors featuring separately formed rod-like or protruding temporary stopping portions.

The following is an explanation of the actions performed by the first protruding portions 44 and the second protruding portions 34 when the cam portion 46 of the actuator 40 is positioned in front of the stopper 75 of the terminals 46 (in the Y1 direction).

When the cam portion 46 is arranged in front of the stopper 75 (in the Y1 direction) and the cam portion 46 is arranged between the stopper 75 of the terminals 60 and the rear upper beam 64 as shown in FIG. 8A and FIG. 8B, the rear end 46*a* of the cam portion 46 pushes downward on the actuator 40 (in the Z2 direction) until the front surface 75*a* of the stopper 75 is reached.

When the actuator 40 has moved in this manner, the space between the left and right second protruding portions 34 is smaller than the space between the surfaces 44*c* of the left and right first protruding portions 44*c*, and the second protruding portions 34 come into contact with the surface 44*c* of the first protruding portions 44 (so as to maintain contact pressure).

As a result, the upper surface 44*d* of the first protruding portions 44 shown in FIG. 9 apply contact pressure to the actuator 40 until it moves downward (in the Z2 direction) from the lower surface 34*d* of the second protruding portions 34 shown in FIG. 1 and FIG. 2.

As shown in FIG. 1 and FIG. 4, the upper surface 44*d* of the first protruding portions 44 move downward (in the Z2 direction) from the lower surface 34*d* of the second protruding portions 34, the surface 44*c* of the first protruding portions 44 separates from the surface 34*c* of the second protruding portions 34 on the actuator 40 side, and the contact pressure applied to the actuator 40 is relieved.

In this way, the width of the actuator 40 in the traverse direction (in the X1 and X2 directions) returns to the width prior to the application of contact pressure, and the surface 44*c* of the first protruding portions 44 on the actuator holding portion 30 side move to the outside of the surface 34*c* of the second protruding portions 34 (in the X1 and X2 directions). As a result, the upper surface 44*d* of the first protruding portions 44 and the lower surface 34*d* of the second protruding portions 34 overlap at least partially in the vertical direction (in the Z1 and Z2 directions) as shown in FIG. 4.

When the first protruding portions 44 engage the second protruding portions 34 of the actuator holding portion 30 in the connector 1 of the present embodiment, movement of the actuator 40 upwards (in the Z1 direction) is restricted. In this way, the cam portion 46 of the actuator 40 is kept from leaving its normal position (in which the rear end 46*a* of the cam portion 46 is positioned on the front surface 75*a* of the stopper 75).

Unlike a connector without this configuration, the connector 1 in the present embodiment does not require a component to prevent the actuator 40 from leaving its normal position. This allows the configuration of the connector 1 to be simplified. Because the configuration of the connector 1 can be simplified, the step required to mount a component to hold the actuator 40 can be eliminated and the costs associated with that component and that step can be eliminated.

An embodiment of the present disclosure was described above, but the present disclosure is not restricted to this embodiment. For example, any configuration explained in the aforementioned embodiment can be replaced by a somewhat similar configuration, a configuration having the same operations and effects, or a configuration able to achieve the same object.

For example, the positions of the first temporary stopping portions 42 and the second temporary stopping portions 32 are not limited to the positions shown in FIG. 2, and FIG. 6 through FIG. 9, and can be adjusted in accordance with the desired position for the cam portion 46. For example, the position of the second temporary stopping portions 32 can be adjusted to the depth of the groove D.

Also, the first temporary stopping portions 42 and the second temporary stopping portions 32 do not have to have a protruding profile. They can also have a recessed profile as long as they can engage each other.

The actuator holding portions 30 do not have to have the protruding profile in the connector 1 of the present embodiment. More specifically, the actuator holding portions 30 and the actuator 40 can engage each other in stages, and the first protruding portions 44 and the second protruding portions 34 can engage each other using a protruding profile and a recessed profile.

The positions of the first protruding portions 44 and the second protruding portions 34 are not limited to the positions shown in the drawings, but can be adjusted in accordance with the desired position for the cam portion 46. For example, the vertical width of the second protruding portions 34 can be adjusted in accordance with the desired position for the cam portion 46.

As shown in FIG. 4 and FIG. 5, the same type of connector 60 was used in the connector 1 of the present embodiment. However, the configuration of the terminals 60 is not limited to the configuration shown in FIG. 4 and FIG. 5. Another configuration may be used. For example, the terminals 60 may include a fixed portion on the front lower beam 78 which is fixed to a circuit board (not shown) outside of the connector 1.

The invention claimed is:

1. A connector which is configured to have a flat cable inserted therein, the connector comprising:

a housing having a bottom portion;

a plurality of terminals housed within the housing, each terminal having a base portion, front and rear upper beams and front and rear lower beams, the base portion extending vertically and having an upper end and a lower end, the rear upper beam extending rearward from the upper end of the base portion, the front upper beam extending forward from the upper end of the base portion, the rear lower beam extending rearward from the lower end of the base portion, the front lower beam extending forward from the lower end of the base portion, the rear lower beam has a fixed portion at a rear end thereof, the fixed portion being configured to be fixed to an external circuit board, the front lower beam has an upwardly protruding contact point which is configured to establish contact with the flat cable to be inserted into the connector, the front lower beam has a lower surface having a front end which establishes contact with an upper surface of the bottom portion of the housing, the contact point being positioned rearward of the front end of the lower surface of the front lower beam; and an actuator having a cam, the cam being arranged between the rear lower beam and the rear upper beam, wherein, when the flat cable is inserted into the connector and the actuator is actuated, the cam is configured to push the rear upper beam upwards, which causes the front upper beam to extend downward at an angle to establish contact with the inserted flat cable, and which causes the front lower beam and the rear lower beam to curve upward with the front end of the lower surface of the front lower beam and the fixed portion of the rear lower beam serving as support points.

2. The connector according to claim 1, wherein, when the rear upper beam is pushed upwards, the housing is inclined so that a rear end of the bottom portion of the housing is positioned above a front end of the bottom portion of the housing, and wherein a gap allowing the housing to be inclined is formed between the upper surface of the rear end of the bottom portion of the housing and the rear lower beam.

3. The connector according to claim 2, wherein the gap extends at least from the rear end of the bottom portion of the housing to the cam and a bottom end of the base portion.

4. The connector according to claim 2, wherein the gap is configured by forming a recess in the upper surface of the bottom portion of the housing.

5. The connector according to claim 1, wherein the front end of the front lower beam is not secured by the housing.

6. The connector according to claim 1, wherein the housing has a ceiling portion, and wherein a tab portion extends upwardly from the upper end of the base portion of each terminal, each tab portion being hooked by the ceiling portion of the housing in order to secure the plurality of terminals in the housing.

7. A connector comprising:

a housing having an accommodating portion and left and right actuator holding portions, the accommodating portion having left and right side walls and a ceiling panel, the left and right side walls composing the left and right side surfaces of the housing, the ceiling panel composing an upper surface of the housing, the left and right actuator holding portions extending rearwardly from a rear of the accommodating portion from the left and right side walls;

a plurality of terminals housed within the housing, each terminal including an upper beam and a lower beam which each extend rearwardly, the lower beam having a stopper having a protruding portion which projects further upwards than a remaining portion of the lower beam, the lower beam being positioned below the upper beam;

an actuator having a cam portion arranged between the upper and lower beams, the actuator arranged between the left and right actuator holding portions, the actuator having left and right first temporary stopping portions protruding toward the cam portion and toward the left and right actuator holding portions, the actuator holding portions each including a second temporary stopping portion protruding toward the actuator, the second temporary stopping portions regulating rearward movement of the first temporary stopping portions when the first temporary stopping portions are in front of the second temporary stopping portions; and left and right grooves which extend from a front end of the ceiling panel to a front end of the respective second temporary stopping portion.

8. The connector according to claim 7, wherein the front end of the second temporary stopping portions can be seen inside the respective groove when the ceiling panel is viewed from above.

9. A connector comprising:

a housing having an accommodating portion and left and right actuator holding portions, the accommodating portion having left and right side walls and a ceiling panel, the left and right side walls composing left and right side surfaces of the housing, the ceiling panel composing an upper surface of the housing, the left and right actuator holding portions extending rearwardly from a rear of the accommodating portion from the left and right side walls;

a plurality of terminals housed within the housing, each terminal including an upper beam and a lower beam which each extend rearwardly, the lower beam having a stopper having a protruding portion which projects further upwards than a remaining portion of the lower beam, the lower beam being positioned below the upper beam; and an actuator having a cam portion arranged between the upper and lower beams and forward of the stopper, the actuator being arranged between the left and right actuator holding portions and restricting upward movement, wherein the actuator includes first protruding portions projecting towards the actuator holding portions, and the actuator holding portions, each includes a second protruding portion projecting towards the actuator, upward movement of the actuator being restricted by the first protruding portions engaging the second protruding portions.

* * * * *